US010790606B2

(12) United States Patent
Chen

(10) Patent No.: US 10,790,606 B2
(45) Date of Patent: Sep. 29, 2020

(54) PLUG CONNECTOR FOR EASY LOCKING AND UNLOCKING

(71) Applicant: OUPIIN ELECTRONIC (KUNSHAN) CO., LTD., Kunshan, Jiangsu province (CN)

(72) Inventor: Hsin Chih Chen, Kunshan (CN)

(73) Assignee: OUPIIN ELECTRONIC (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 16/699,749

(22) Filed: Dec. 2, 2019

(65) Prior Publication Data

US 2020/0176915 A1 Jun. 4, 2020

(30) Foreign Application Priority Data

Dec. 3, 2018 (CN) ..... 2018 1 1462342
Dec. 3, 2018 (CN) ..... 2018 2 2006851 U

(51) Int. Cl.

| | |
|---|---|
| ***H01R 4/66*** | (2006.01) |
| ***H01R 13/426*** | (2006.01) |
| ***H01R 13/115*** | (2006.01) |
| ***H01R 24/64*** | (2011.01) |
| *H01R 107/00* | (2006.01) |

(52) U.S. Cl.

CPC ..... *H01R 13/426* (2013.01); *H01R 13/115* (2013.01); *H01R 24/64* (2013.01); *H01R 2107/00* (2013.01); *H01R 2201/04* (2013.01)

(58) Field of Classification Search

CPC .. H01R 4/646; H01R 13/658; H01R 13/5841; H01R 13/516; H01R 13/5804

USPC ..... 439/99, 98, 446, 464, 471

See application file for complete search history.

(56) References Cited

U.S. PATENT DOCUMENTS

| | | | | |
|---|---|---|---|---|
| 7,074,087 | B2 * | 7/2006 | Szczesny | H01R 9/032 439/607.41 |
| 7,442,072 | B2 * | 10/2008 | Droesbeke | H01R 13/5808 439/460 |
| 7,534,125 | B1 * | 5/2009 | Schroll | H01R 13/6275 439/157 |
| 8,348,681 | B2 * | 1/2013 | Phillips | G02B 6/4201 439/99 |
| 9,263,831 | B2 * | 2/2016 | Shen | H01R 13/6272 |
| 9,310,572 | B2 * | 4/2016 | Keenum | G02B 6/428 |
| 2007/0275591 | A1 * | 11/2007 | Weber | H01R 13/6598 439/460 |
| 2009/0227133 | A1 * | 9/2009 | Zhang | G02B 6/4246 439/160 |

* cited by examiner

*Primary Examiner* — Phuong Chi Thi Nguyen
(74) *Attorney, Agent, or Firm* — Mark M. Friedman

(57) ABSTRACT

A plug connector for easy locking and unlocking is disclosed, including a base, a signal transmission module, a lock head, a cover and a pull strip. The plug connector of the present invention employs a holding-down structure of the pull strip, which can drive an edge block of the lock head to go down and further force the lock head to go down by pulling the pull strip backward. When releasing the pull strip, the lock head can automatically go up. Therefore, in the present invention, the pull strip can control the lock head, thereby completing the locking and unlocking work. The locking and unlocking way of the present invention is safe, effective and convenient.

10 Claims, 16 Drawing Sheets

PLUG CONNECTOR FOR EASY LOCKING AND UNLOCKING

BACKGROUND OF THE INVENTION

1. Field of the Invention

The present invention relates to a connector technology, and more particularly to a plug connector for easy locking and unlocking.

2. Description of the Prior Art

Locking devices are usually disposed on a plug connector and a socket connector, which can be engaged together, to prevent them from loosening due to external forces after docking, thereby ensuring the reliability and safety of mechanical connection between them.

A common locking way is to set a lock head on the plug connector.

Please refer to FIG. 1, an RJ45 plug 9 for computer networks disposes a lock head 90. When the RJ45 plug 9 is inserted into an RJ45 socket 8, first the lock head 90 is pressed downward, then the plug 9 enters into the socket 8, and the lock head 90 is engaged with a block 80 in the socket 8, thereby locking the plug 9 and the socket 8 together. When needing to unlock them, first the lock head 90 is pressed downward again, and is detached from the block 80, thereby unlocking the plug 9 and the socket 8.

However, there are many shortcomings in this locking and unlocking way. For example, the lock head 90 can cause too much insertion force of the plug 9. When unlocking, because of the difficulty in pressing the lock head 90, it is even necessary to use an auxiliary tool for pressing the lock head 90 in place. So the existing unlocking operation is difficult.

Hence, it is necessary to provide a new plug connector that adopts a new unlocking way to solve the problem existing in the prior art.

BRIEF SUMMARY OF THE INVENTION

A primary object of the present invention is to provide a plug connector for each locking and unlocking, which is safe, effective and convenient to lock and unlock.

Other objects and advantages of the present invention may be further understood from the technical features disclosed by the present invention.

To achieve the aforementioned object or other objects of the present invention, the present invention adopts the following technical solution.

The present invention provides a plug connector for easy locking and unlocking, comprising a base, a signal transmission module being mounted in the base, a lock head being fixed on the base and the signal transmission module, a cover being mounted on the base, and a pull strip being mounted on the cover. The lock head has an L-shaped elastic arm, a fixed end formed on one end of the elastic arm, a free end formed on the other end of the elastic arm, and at least one shoulder formed on the elastic arm. The fixed end is fixed on the base, and the free end is located above the base and extending backward. The free end forms at least one edge block, which is located on rear of the shoulder. The pull strip is flat ribbon-shaped, and forms at least one holding-down structure on a front end of the pull strip to drive the edge block to move downward. When pulling the pull strip backward, the holding-down structure can force the lock head to go down; and when releasing the pull strip, the lock head can automatically go up to its original position.

In one embodiment, the edge block has two upward inclined surfaces, including a first inclined surface and a second inclined surface, which are parallel to each other; and the second inclined surface is higher than the first inclined surface.

In one embodiment, the holding-down structure includes an upright long arm and an upright short arm; the long arm and the arm are formed by vertically bent from the front end of the pull strip and extend downward; the long arm is perpendicular to the short arm; the long arm is located in front of the edge block, and the short arm is located above the edge block; when pulling the pull strip backward, the long arm can press against a front end of the first inclined surface, and the short arm can press against the second inclined surface.

In one embodiment, the long arm has a bending piece formed by bending a bottom end of the long arm, the bending piece is parallel to the long arm and faces the edge block; when the pull strip moves backward, the bending piece can press against the front end of the first inclined surface, and an oblique edge formed on a bottom of the short arm can press against the second inclined surface.

In one embodiment, the length of the first inclined surface is greater than that of the second inclined surface.

In one embodiment, wherein the long arm further has a reinforcing rib.

In one embodiment, the cover has a horizontal top wall, and two symmetrical vertical sidewalls perpendicular to the horizontal top wall; the horizontal top wall forms two symmetrical limiting grooves and a limiting block located between the two limiting grooves; the limiting block is located on a middle of the horizontal top wall, and the two limiting grooves are symmetrically located on two sides of the limiting block; the pull strip further has a middle groove in a middle of the pull strip, a pair of horizontal side wings on two sides of the pull strip, and a pull ring on a rear of the pull strip; wherein the pair of side wings is inserted into the two limiting grooves, the limiting block enters into the middle groove and protrudes out of the middle groove, and the pull ring extends out of the cover.

In one embodiment, each limiting groove can be a complete continuous groove or a disconnected discontinuous groove.

In one embodiment, the middle groove is slender, and has a large opening on one end of the middle groove, and the limiting block of the cover can pass through the opening to enter into the middle groove.

In one embodiment, the base has a U-shaped receiving portion, and an inverted U-shaped plug portion communicated with the receiving portion; the signal transmission module has a front portion, a rear portion, multiple electrical contact terminals located at the front portion and exposed on a bottom of the front portion, and a cable extending out of the rear portion; wherein the front portion enters into the plug portion, the electrical contact terminals are exposed to outside from a bottom of the plug portion, the rear portion is placed into the receiving portion, and the cable extends out of the base; the free end of the lock head is above the plug portion and extends backward freely; the free end forms two edge blocks, which are symmetrically located on left and right sides of the free end; the elastic arm forms two symmetrical shoulders; the two shoulders and the two edge blocks are above the base; and the pull strip forms two symmetrical holding-down structures on the front end of the pull strip for driving the corresponding edge blocks to move downward.

In comparison with the prior art, the plug connector of the present invention employs the holding-down structure, which can drive the corresponding edge block to go down and further force the lock head to go down by pulling the pull strip backward. When releasing the pull strip, the lock head can automatically go up. Therefore, in the present invention, the pull strip can control the lock head, thereby completing the locking and unlocking work. The locking and unlocking way of the present invention is safe, effective and convenient.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" "above", "below" etc., are only used with reference to the orientation of the accompanying drawings. Therefore, the used directional terms are intended to illustrate, but not to limit, the present invention.

Figure 1:
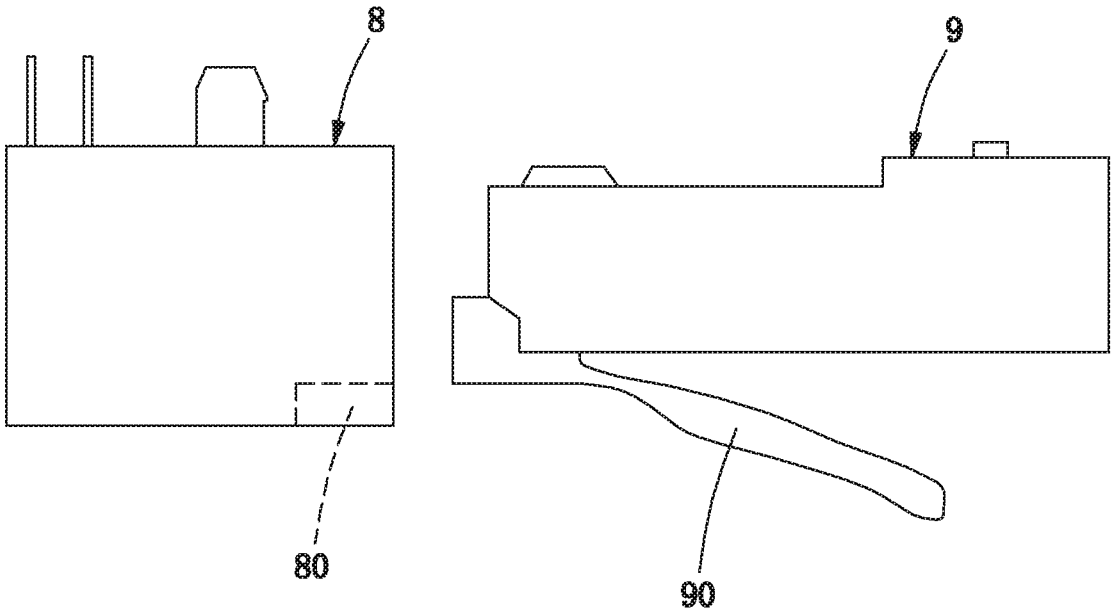
FIG. 1 is a schematic view of an existing plug, which mainly shows a lock head having locking and unlocking functions.
Figure 2:
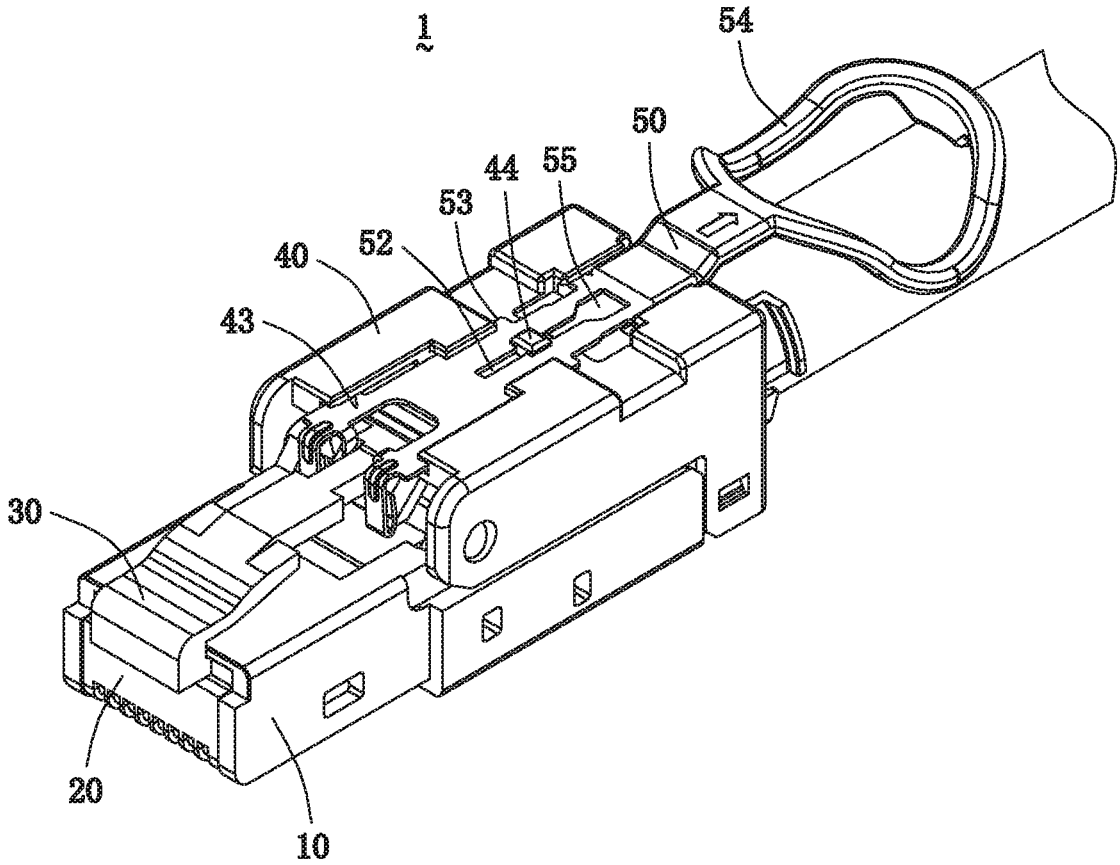
FIG. 2 is a perspective view of a plug connector of the present invention.
Figure 3:
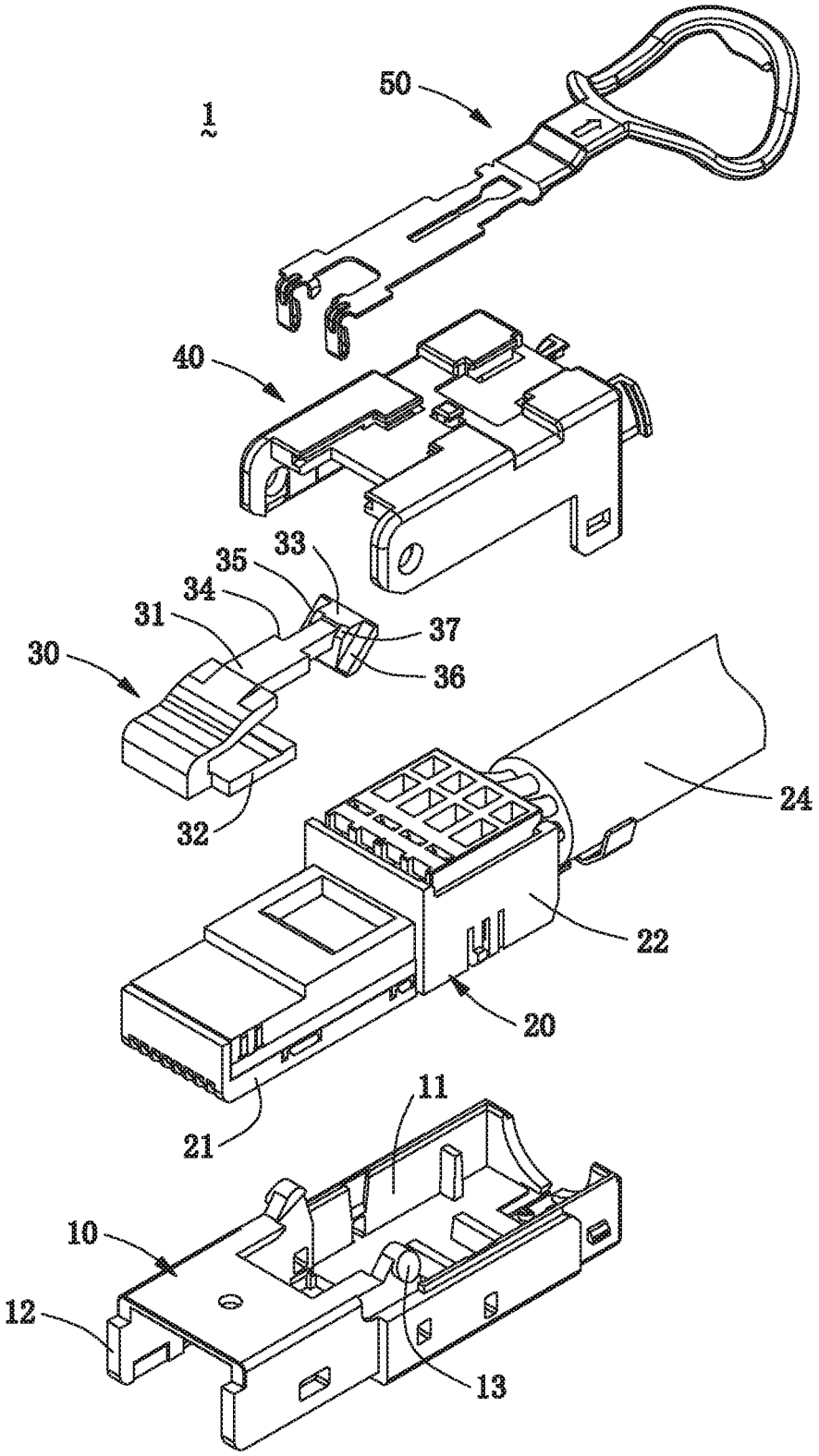
FIG. 3 is an exploded view of the plug connector of the present invention.

Please refer to FIGS. 2 and 3, a plug connector 1 of the present invention includes a base 10, a signal transmission module 20 mounted in the base 10, a lock head 30 fixed on the base 10 and the signal transmission module 20, a cover mounted on the base 10, and a pull strip 50 mounted on the cover 40.

Please refer to FIG. 3, the base 10 has a U-shaped receiving portion 11, and an inverted U-shaped plug portion 12 communicated with the receiving portion 11. The base 10 further has a shaft 13 on each side surface of the receiving portion 11 to protrude outward.

It should be noted that the so-called U-shaped and inverted U-shaped are defined with reference to the direction shown in drawings.

Referring to FIG. 3, the signal transmission module 20 has a front portion 21, a rear portion 22, multiple electrical contact terminals 23 (seen in FIG. 5) located at the front portion 21 and exposed on a bottom of the front portion 21, and a cable 24 extending out of the rear portion 22.

Figure 4:
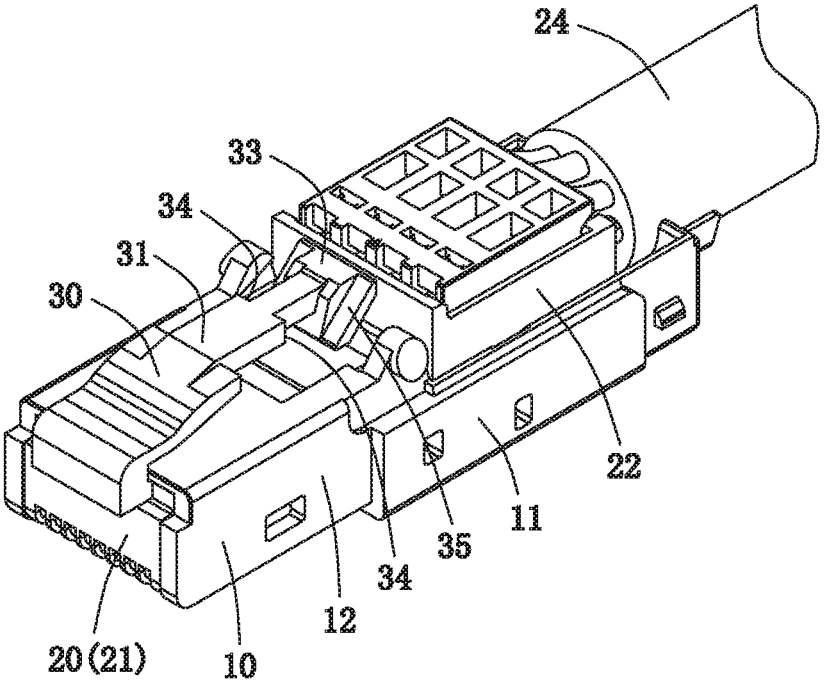
FIG. 4 is a schematic view of a base, a signal transmission module, and a lock head after being combined together in the present invention.
Figure 5:
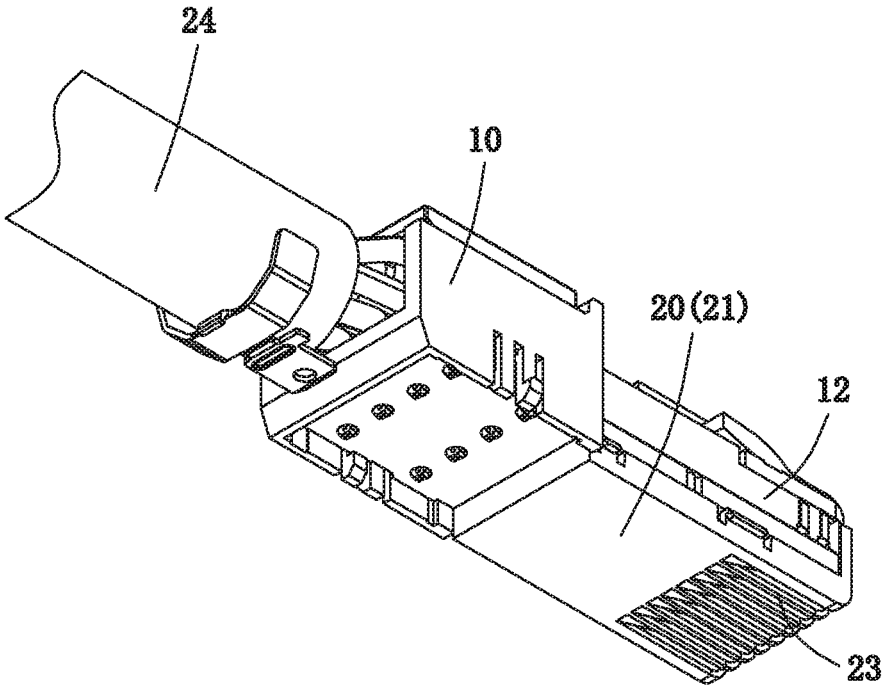
FIG. 5 is a schematic view of the structure of FIG. 4 along another direction.
Figure 15:
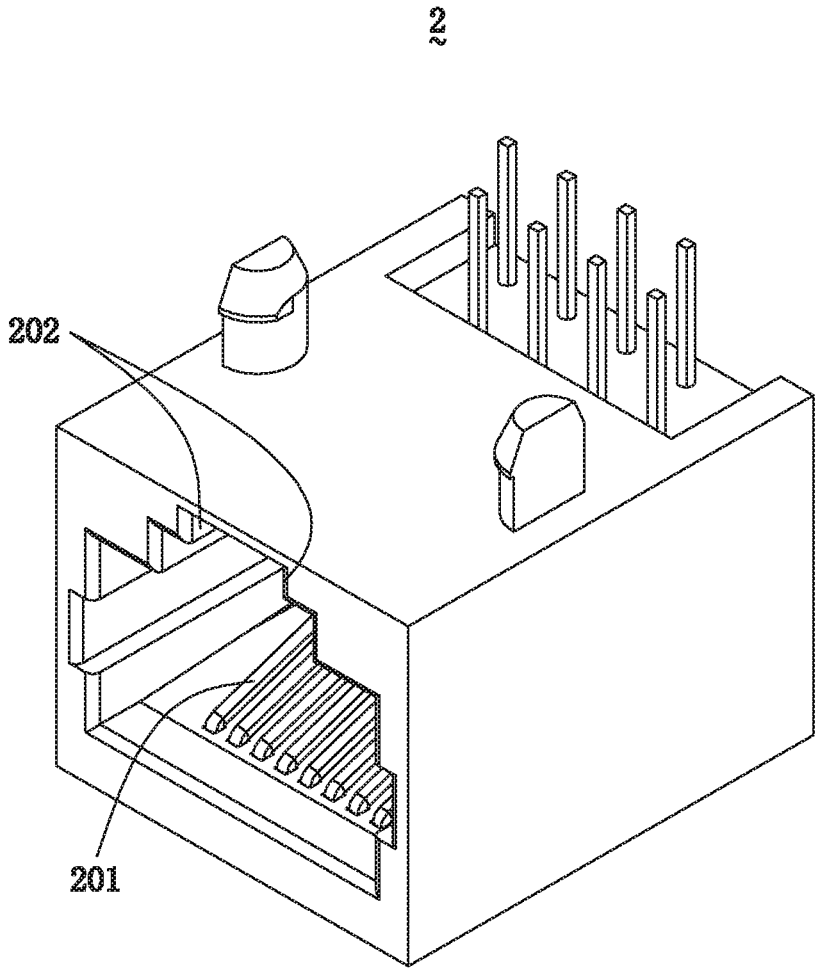
FIG. 15 is a structure schematic view of a socket connector.

Referring to FIGS. 3 to 5, the signal transmission module 20 is mounted in the base 10, wherein the front portion 21 enters into the plug portion 12; the electrical contact terminals 23 are exposed to the outside from a bottom of the plug portion 12 for being ready to electrically contact with socket terminals 201 of a socket connector 2 as shown in FIG. 15; the rear portion 22 is placed into the receiving portion 11; and the cable 24 extends out of the base 10.

Referring to FIG. 3, the lock head 30 has an elastic arm 31 being generally L-shaped, a fixed end 32 on one end of the elastic arm 31, a free end 33 on the other end of the elastic arm 31, and at least one shoulder 34 formed on the elastic arm 31. The free end 33 forms at least one edge block 35 thereon. The edge block 35 is on rear of the shoulder 34, and has at least one inclined surface facing the shoulder 34. In the embodiment, the elastic arm 31 forms two symmetrical shoulders 34, and the free end 33 forms two edge blocks 35, which are located on left and right sides of the free end 33, respectively.

In the embodiment, each edge block 35 has two upward inclined surfaces, such as a first inclined surface 36 and a second inclined surface 37. The second inclined surface 37 is roughly parallel to the first inclined surface 36, and higher than the first inclined surface 36. The length of the first inclined surface 36 is greater than that of the second inclined surface 37, but their slopes are basically the same. Of course, in other embodiments, the slopes of the first inclined surface 36 and the second inclined surface 37 can be different, or the two inclined surfaces 36, 37 can also be regarded as one inclined surface.

Please refer to FIG. 4, the lock head 30 is fixed on the base 10 and located above the plug portion 12 of the base 10. Specifically, the fixed end 32 (seen in FIG. 3) of the elastic arm 31 is fixed on the base 10, and particularly clamped between the base 10 and the signal transmission module 20. The free end 32 of the elastic arm 31 is located above the plug portion 12 of the base 10 and extends backward freely. Moreover, the two shoulders 33 and the two edge blocks 35 are located above the base 10. The lock head 30 can go down under the action of an external force and automatically go up when the external force disappears.

Figure 6:
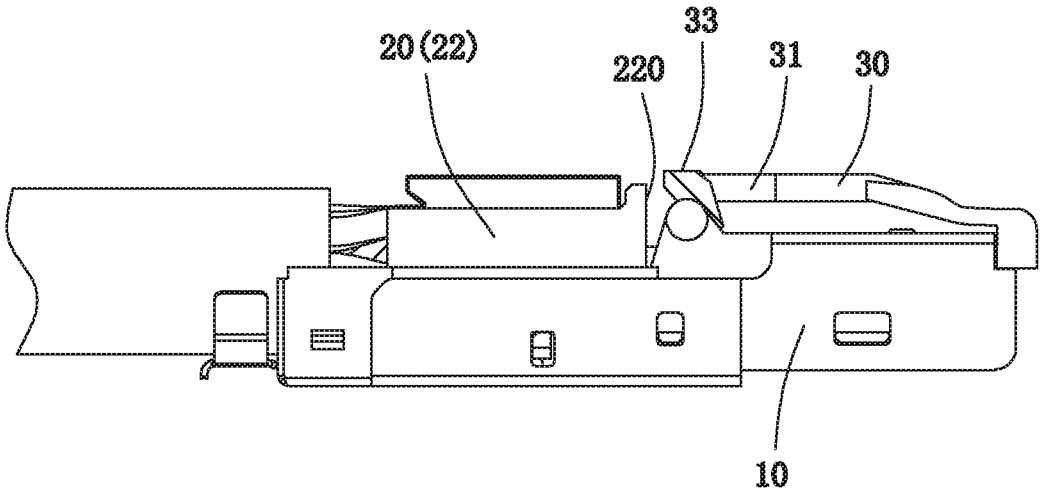
FIG. 6 is a side plan view of the structure of FIG. 4.

Moreover, referring to FIG. 6, when the lock head 30 is fixed on the base 10, there is a certain distance between the free end 32 of the elastic arm 31 and a front surface 220 of the rear portion 22 of the signal transmission module 20. Thus, when the lock head 30 is forced to go down, the free end 33 will not be blocked by the signal transmission module 20.

Figure 7:
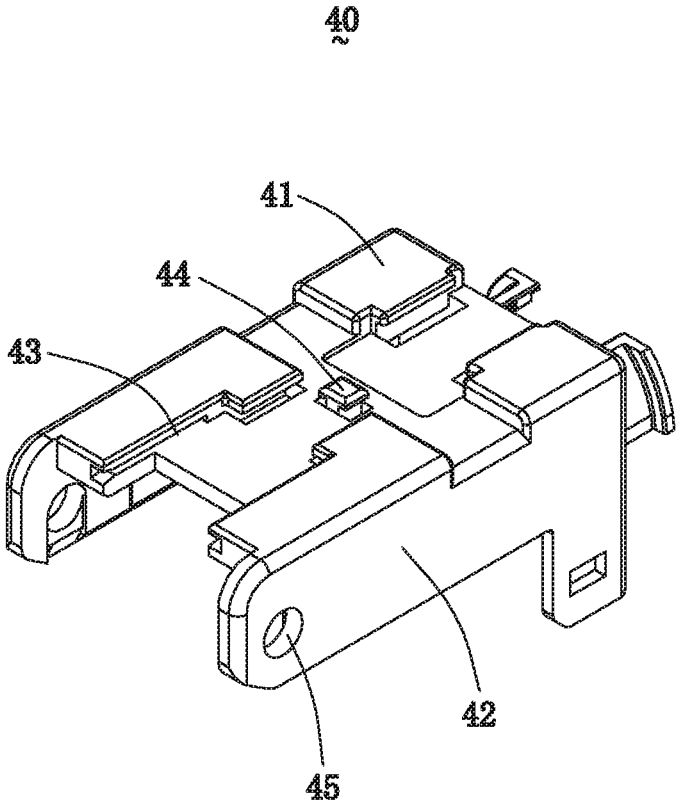
FIG. 7 is a schematic view of a cover of the present invention.
Figure 8:
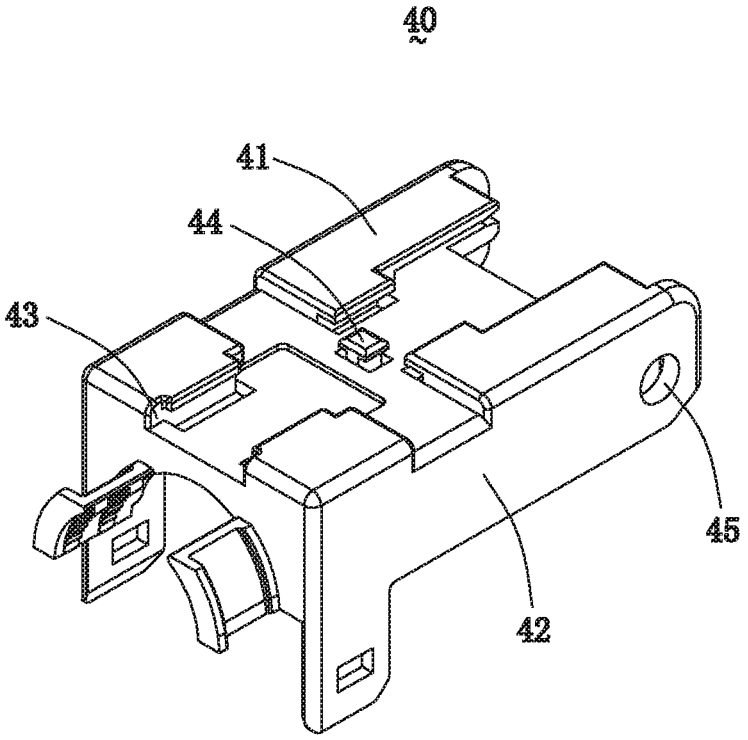
FIG. 8 is a schematic view of the cover of the present invention along another direction.

Please refer to FIGS. 7 and 8, the cover 40 has a horizontal top wall 41, and two symmetrical vertical sidewalls 42 perpendicular to the horizontal top wall 41. The horizontal top wall 41 forms two symmetrical limiting grooves 43 and a limiting block 44 located between the two limiting grooves 43. Each limiting groove 43 may be a complete continuous groove or a disconnected discontinuous groove. The limiting block 44 is located on a middle of the horizontal top wall 41, and the two limiting grooves 43 are symmetrically located on two sides of the limiting block 44. Moreover, in the embodiment, each vertical sidewall 42 forms an axis hole 45 for being engaged with the corresponding shaft 13 of the base 10.

Figure 9:
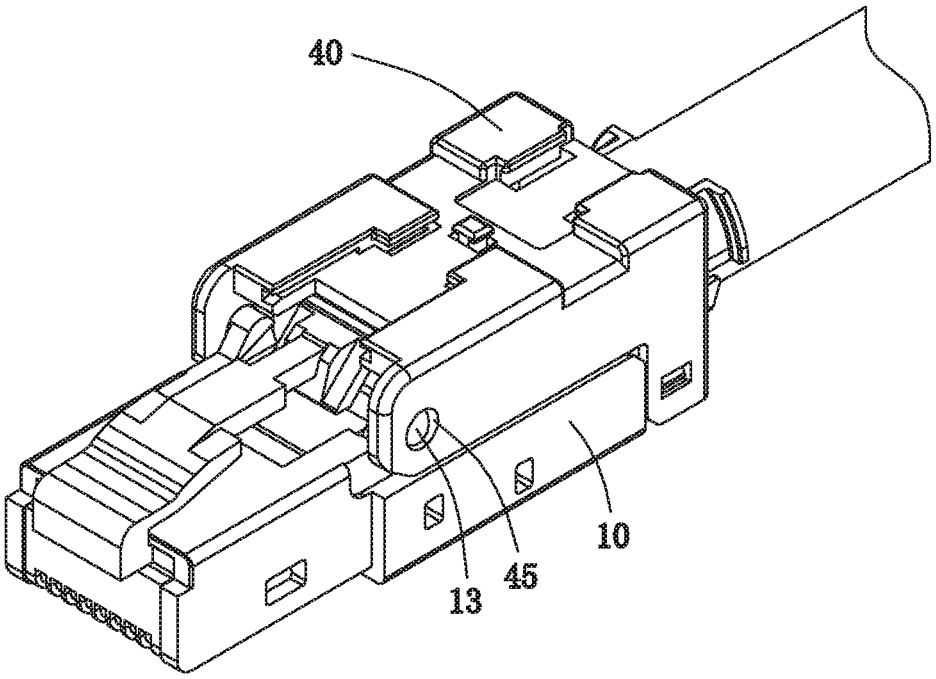
FIG. 9 is a schematic view of the plug connector after removing a pull strip.

Please refer to FIG. 9, the cover 40 is mounted on the base 10, and the shaft 13 is engaged with the corresponding axis hole 45, thereby fixing the cover 40 on the base 10. Of course, the cover 40 and the base 10 can also be provided with other structures to be used for further fixing the both.

Figure 10:
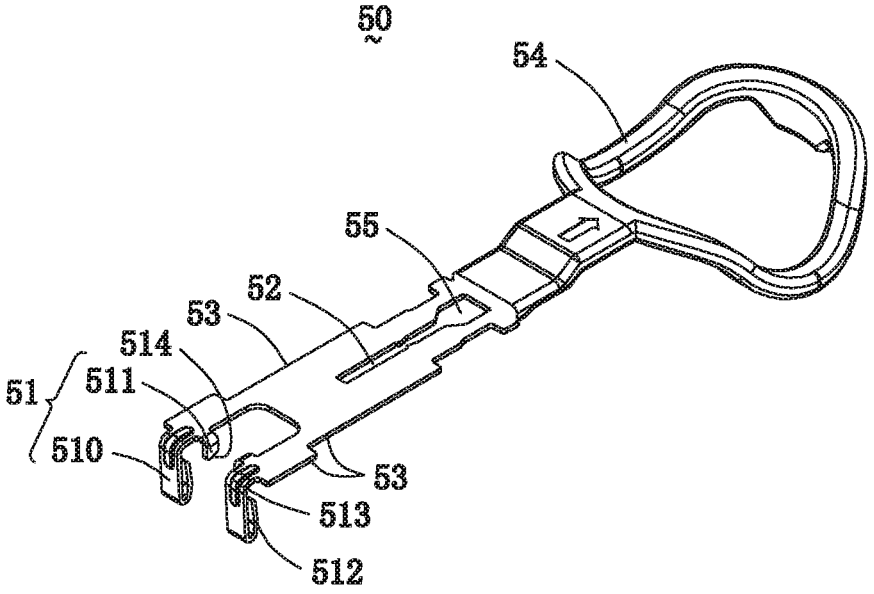
FIG. 10 is a schematic view of the pull strip of the plug connector of the present invention.
Figure 11:
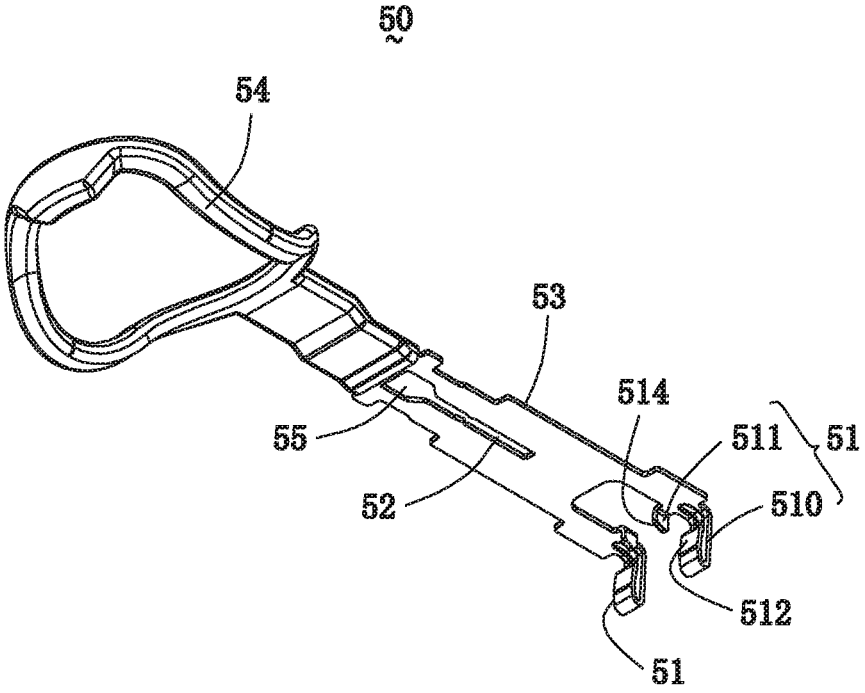
FIG. 11 is a schematic view of the pull strip along another direction.

Please refer to FIGS. 10 and 11, the pull strip 50 is flat ribbon-shaped. The pull strip 50 forms two holding-down structures 51, which are left-right symmetrical, on a front end of the pull strip 50. Each holding-down structure 51 can drive the corresponding edge block 35 (seen in FIG. 3) to force the lock head 30 to go down. Specifically, each holding-down structure 51 includes an upright long arm 510 and an upright short arm 511. The long arm 510 and the short arm 511 are vertically bent from the front end of the pull strip 50 and extend downward, and are perpendicular to each other. In other words, a plane of the long arm 510 is perpendicular to that of the short arm 511. The long arm 510 is longer than the short arm 511. Furthermore, the long arm 510 has a bending piece 512 formed on a bottom end thereof and being parallel to the long arm 510. The bending piece 512 faces the corresponding edge block 35. The long arm 510 also has a reinforcing rib 513. The bending piece 512 and the reinforcing rib 513 can enhance the strength of the long arm 510 to provide sufficient thrust for the edge block 35. The long arm 510 is located at the front end of the pull strip 50, and the short arm 511 is slightly near a center of the pull strip 50. Moreover, the short arm 511 forms an oblique edge 514 on a bottom thereof. A slope of the oblique edge 514 is generally the same as that of the second inclined surface 37 (seen in FIG. 3), so as to be advantageous to press the corresponding edge block 35 downward.

Please refer to FIGS. 10 and 11, the pull strip 50 further has a middle groove 52 in a middle of the pull strip 50, a pair of horizontal side wings 53 on two sides of the pull strip 50, and a pull ring 54 on a rear of the pull strip 50. In the embodiment, the middle groove 52 is slender, and has a large opening 55 on one end of the middle groove, so that the limiting block 44 (seen in FIG. 7) of the cover 40 can pass through the opening 55 to enter into the middle groove 52. The pair of side wings 53 is actually left and right edges of the pull strip 50. Moreover, in the embodiment, the pull ring 54 is an independent component, which is made of plastic and is mounted on the rear of the pull strip 50.

Figure 12:
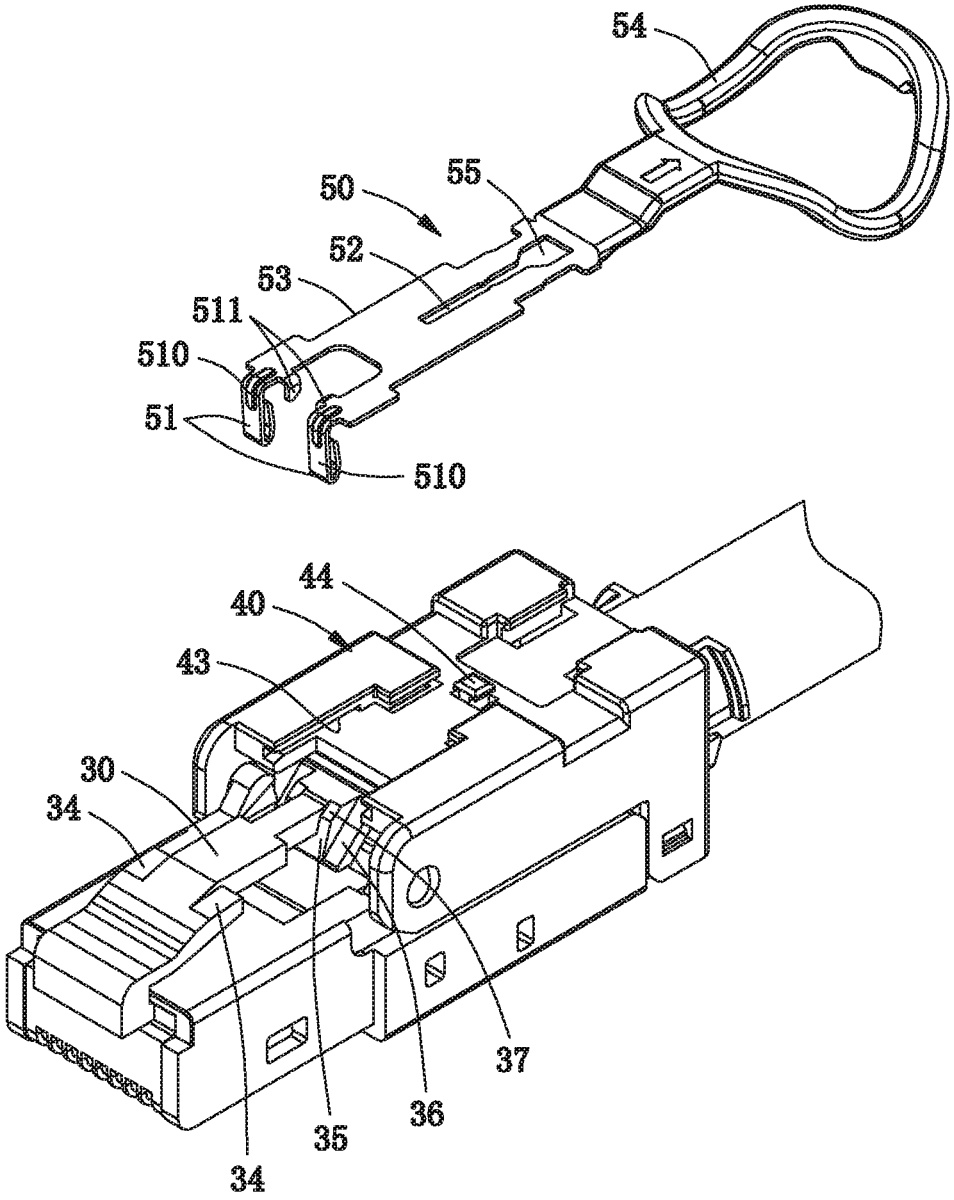
FIG. 12 is a perspective view of the plug connector, a part of which is disassembled.

Please refer to FIGS. 12 and 2, the pull strip 50 is mounted on a top of the cover 40. The pair of side wings 53 of the pull strip 50 is inserted into the two limiting grooves 43 of the cover 40, and the limiting block 44 enters into the middle groove 52 from the opening 55 and protrudes out of the middle groove 52. The pull ring 54 extends out of the cover 40 to facilitate user operation.

Figure 13:
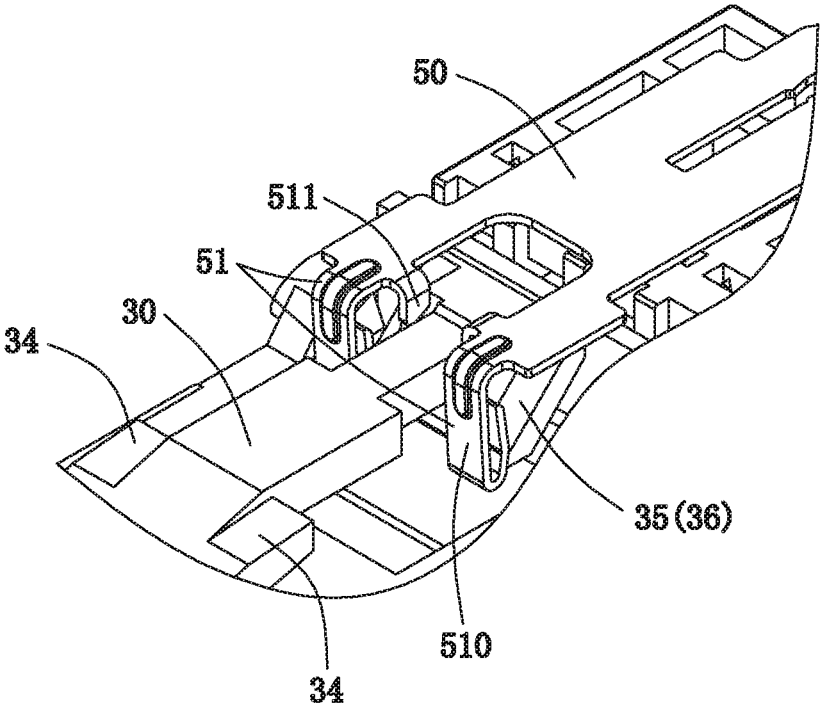
FIG. 13 is a detailed structure view showing the relationship of the lock head and the pull strip.
Figure 14:
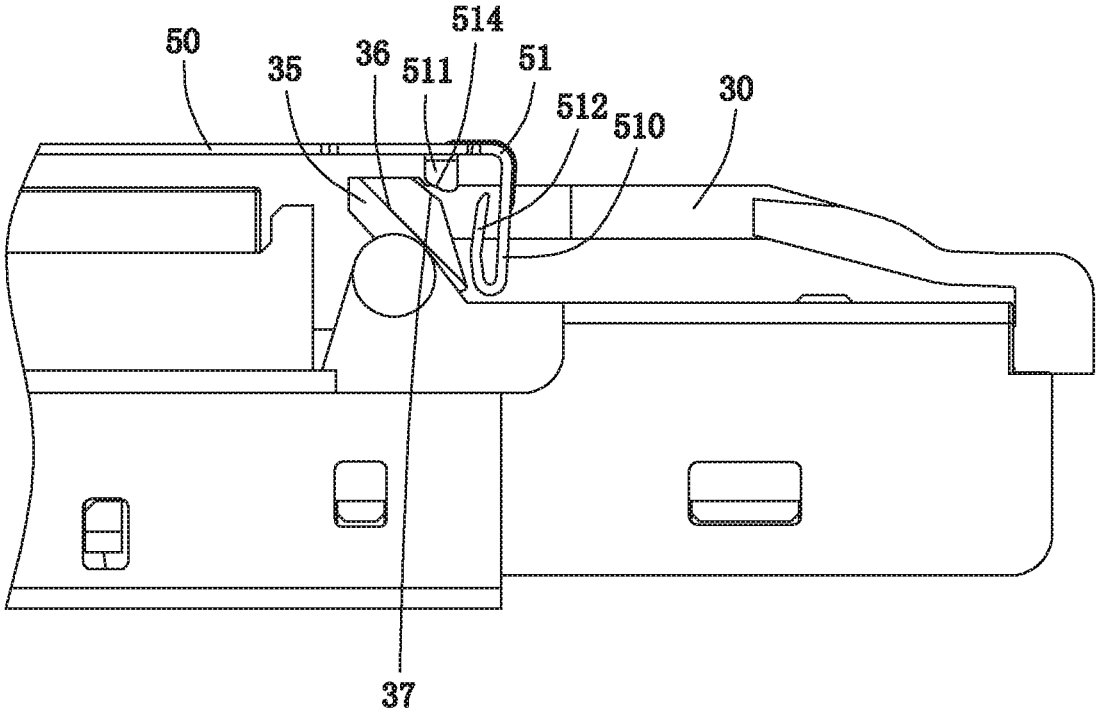
FIG. 14 is a plan structure view showing the relationship of the lock head and the pull strip.

More specifically, referring to FIGS. 13 and 14, the two holding-down structures 51 of the pull strip 50 are corresponding to the two edge blocks 35 of the lock head 30 respectively. Each long arm 510 is in front of the corresponding edge block 35, and each short arm 511 is above the corresponding edge block 35. When the pull strip 50 moves backward, the long arm 510 can press against a front end of the first inclined surface 36, and the short arm 511 can press against the second inclined surface 37. In the embodiment, when the pull strip 50 moves backward, the bending piece 512 of the long arm 510 presses against the front end of the first inclined surface 36, and the oblique edge 514 of the short arm 511 presses against the second inclined surface 37.

Please refer to FIGS. 12 and 13, when pulling the pull strip 50 backward, the two long arms 510 of the two holding-down structures 51 can simultaneously push the first inclined surfaces 36 of the corresponding edge blocks 35 backward, while the two short arms 511 can simultaneously press the corresponding second inclined surface 37 downward. When the pull strip 50 moves backward, the lock head 30 can be forced to go down under the combined action of the long arm 510 and the short arm 511, particularly, the two shoulders 34 of the lock head 30 can go down, so the plug connector 1 can be successfully inserted into a socket connector 2 of FIG. 15.

When releasing the pull strip 50, the lock head 30 can automatically return to its original position due to loss of the external force. With the lock head 30 going up, the pull strip 50 can move forward to it original state, so that the two shoulders 34 of the lock head 30 can be engaged with two blocks 202 (seen in FIG. 15) disposed inside the socket connector 2. Now, the plug connector 1 will not exit from the socket connector 2.

Figure 16:
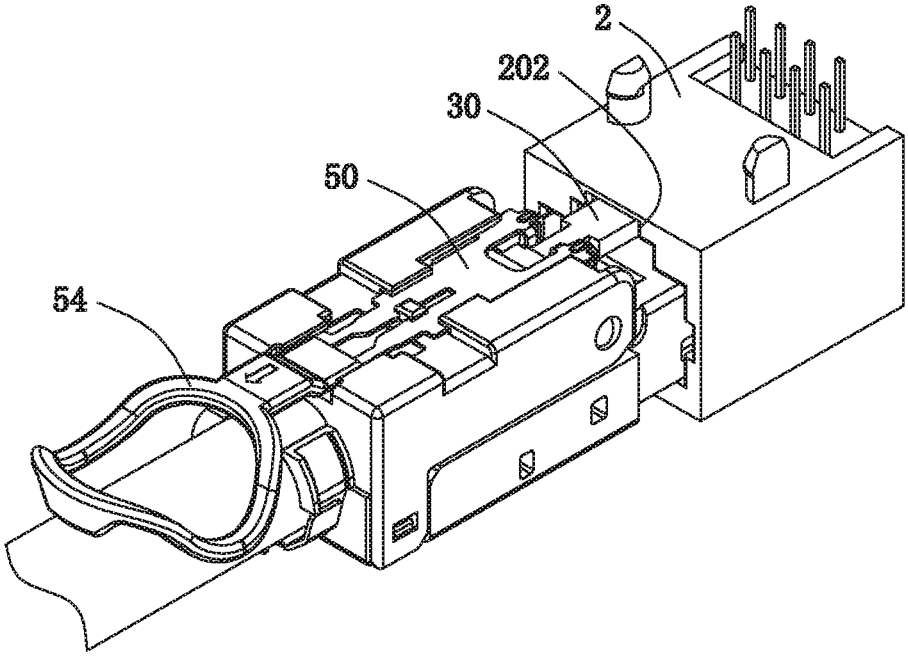
FIG. 16 is a schematic view showing that the plug connector is inserted into the socket connector.

When needing to unlock, referring to FIG. 16, the pull ring 54 needs to be pulled backward again, then the pull strip 50 can move backward and force the lock head 30 (seen in FIG. 2) to go down, the two shoulders 34 (seen in FIG. 12) will not be blocked by the blocks 202 of the socket connector 2 and can go backward, so that the plug connector 1 can be pulled out successfully.

As described above, the plug connector 1 of the present invention can force the lock head 30 to go down by pulling the pull strip 50 backward, thereby realizing to unlock. When releasing the pull strip 50, the lock head 30 can go up with the help of automatically returning, thereby realizing to lock. Therefore, in the present invention, the pull strip 50 can control the lock head 30, thereby completing the locking and unlocking work. The locking and unlocking way of the present invention is safe, effective and convenient.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector for easy locking and unlocking, comprising:

a base;

a signal transmission module, being mounted in the base;

a lock head, being fixed on the base and the signal transmission module; the lock head having an L-shaped elastic arm, a fixed end formed on one end of the elastic arm, a free end formed on the other end of the elastic arm, and at least one shoulder formed on the elastic arm; the fixed end being fixed on the base, and the free end being located above the base and extending backward; the free end forming at least one edge block, which is located on rear of the shoulder;

a cover, being mounted on the base; and a pull strip, being mounted on the cover and being flat ribbon-shaped; the pull strip forming at least one holding-down structure on a front end of the pull strip to drive the edge block to move downward;

when pulling the pull strip backward, the holding-down structure can force the lock head to go down; and when releasing the pull strip, the lock head can automatically go up to its original position.

2. The plug connector as claimed in claim 1, wherein the edge block has two upward inclined surfaces, including a first inclined surface and a second inclined surface, which are parallel to each other; and the second inclined surface is higher than the first inclined surface.

3. The plug connector as claimed in claim 1, wherein the cover has a horizontal top wall, and two symmetrical vertical sidewalls perpendicular to the horizontal top wall; the horizontal top wall forms two symmetrical limiting grooves and a limiting block located between the two limiting grooves; the limiting block is located on a middle of the horizontal top wall, and the two limiting grooves are symmetrically located on two sides of the limiting block;

the pull strip further has a middle groove in a middle of the pull strip, a pair of horizontal side wings on two sides of the pull strip, and a pull ring on a rear of the pull strip;

wherein the pair of side wings is inserted into the two limiting grooves, the limiting block enters into the middle groove and protrudes out of the middle groove, and the pull ring extends out of the cover.

4. The plug connector as claimed in claim 3, wherein each limiting groove can be a complete continuous groove or a disconnected discontinuous groove.

5. The plug connector as claimed in claim 3, wherein the middle groove is slender, and has a large opening on one end of the middle groove, and the limiting block of the cover can pass through the opening to enter into the middle groove.

6. The plug connector as claimed in claim 1, wherein the base has a U-shaped receiving portion, and an inverted U-shaped plug portion communicated with the receiving portion;

the signal transmission module has a front portion, a rear portion, multiple electrical contact terminals located at the front portion and exposed on a bottom of the front portion, and a cable extending out of the rear portion; wherein the front portion enters into the plug portion, the electrical contact terminals are exposed to outside from a bottom of the plug portion, the rear portion is placed into the receiving portion, and the cable extends out of the base;

the free end of the lock head is above the plug portion and extends backward freely; the free end forms two edge blocks, which are symmetrically located on left and right sides of the free end; the elastic arm forms two symmetrical shoulders; the two shoulders and the two edge blocks are above the base; and the pull strip forms two symmetrical holding-down structures on the front end of the pull strip for driving the corresponding edge blocks to move downward.

7. The plug connector as claimed in claim 2, wherein the length of the first inclined surface is greater than that of the second inclined surface.

8. The plug connector as claimed in claim 2, wherein the holding-down structure includes an upright long arm and an upright short arm; the long arm and the arm are formed by vertically bent from the front end of the pull strip and extend downward; the long arm is perpendicular to the short arm; the long arm is located in front of the edge block, and the short arm is located above the edge block; when pulling the pull strip backward, the long arm can press against a front end of the first inclined surface, and the short arm can press against the second inclined surface.

9. The plug connector as claimed in claim 8, wherein the long arm has a bending piece formed by bending a bottom end of the long arm, the bending piece is parallel to the long arm and faces the edge block; when the pull strip moves backward, the bending piece can press against the front end of the first inclined surface, and an oblique edge formed on a bottom of the short arm can press against the second inclined surface.

10. The plug connector as claimed in claim 9, wherein the long arm further has a reinforcing rib.

* * * * *